United States Patent [19]

Heffernan et al.

[11] 4,184,193

[45] Jan. 15, 1980

[54] MULTI-PURPOSE LANTERN

[75] Inventors: William R. Heffernan, Westfield; Mary-Louise Vega, Califon, both of N.J.; Joel A. Gingras, Sr., Doylestown, Pa.

[73] Assignee: American Cyanamid Company, Stanford, Conn.

[21] Appl. No.: 915,428

[22] Filed: Jun. 14, 1978

[51] Int. Cl.[2] ..... F21K 2/00

[52] U.S. Cl. ..... 362/34; 362/296; 362/310; 362/311; 362/347; 362/375

[58] Field of Search ..... 362/34, 296, 310, 311, 362/347, 375

[56] References Cited

U.S. PATENT DOCUMENTS 3,884,560 5/1975 Neylan et al. ..... 362/34 X

*Primary Examiner*—Stephen J. Lechert, Jr.

*Attorney, Agent, or Firm*—Gordon L. Hart

[57] ABSTRACT

A lantern is described in which a chemiluminescent lightstick serving as the light source is held in place before a curved reflective sheet for projection of the light through a window of the lantern.

4 Claims, 6 Drawing Figures

MULTI-PURPOSE LANTERN

The invention relates to improvements in lighting devices, particularly of a kind that employs a chemiluminescent lightstick as the light source.

The present invention provides a novel reflective lantern comprising means for holding a lightstick in the lantern at a fixed position and a curved reflective surface in the lantern to direct light produced by the lightstick outward through a window of the lantern. The lantern comprises a frame which holds a flexible, resilient reflective sheet in a curved configuration to provide the reflective surface of the lantern, and the frame may have other fittings for affixing the lantern to various objects and to facilitate other convenient uses of the lantern.

The device of the invention may be used to advantage with several kinds of chemiluminescent lightsticks that are known. We refer to several U.S. patents for more detailed description of chemiluminescent lightsticks, for example, U.S. Pat. No. 3,576,987; 3,813,534; 3,539,794, and the like.

Lightsticks of the kind to be used in devices according to the present invention will typically comprise a cylindrical outer tube of flexible translucent material in which several chemical components of a chemiluminescent mixture are enclosed. Within said outer tube, the components are separated by frangible means until light is needed. The lightstick may be activated by bending the flexible outer tube enough to break the frangible separating means, e.g. one or more glass vials within the tube, thereby combining the several components of the chemiluminescent mixture inside the sealed outer tube. Any chemiluminescent mixture may be used in accordance with the invention, some preferred ones being those chemical systems described in U.S. Pat. No. 3,597,362; 3,749,679; 3,729,426; 3,775,336, and the like. The chemiluminescent lightstick produces visible light without the need for an external power source and without the emission of heat, smoke, flames or gas. The lightstick is a self-contained source for cold light. It can be used safely in explosive atmospheres and it can be used under water.

The invention will be described in more detail with reference to the drawings. In the drawings.

Figure 1:
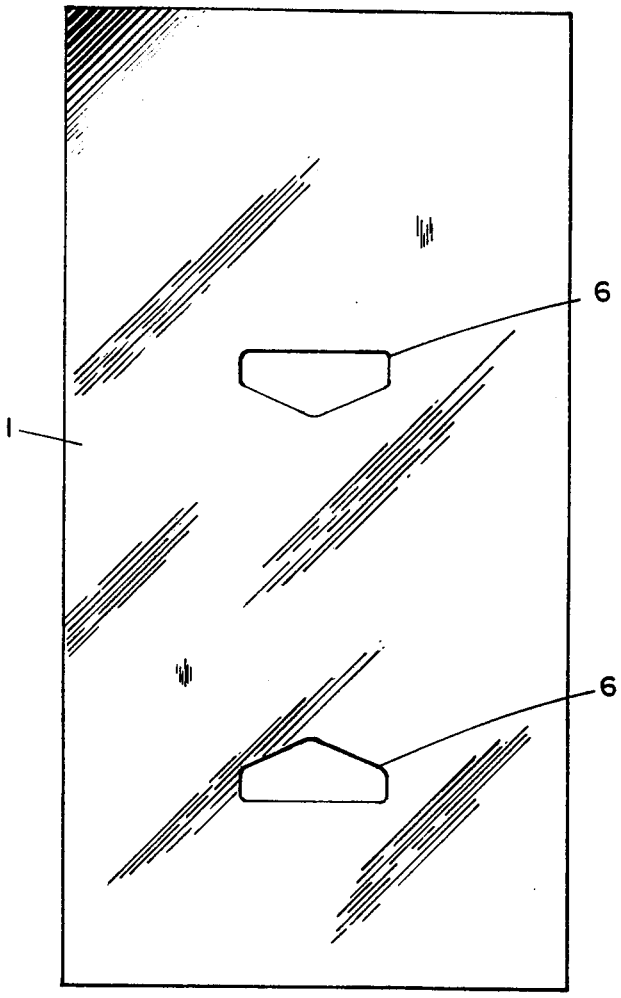
FIG. 1 illustrates a flexible resilient reflective sheet which provides the reflective surface in the lantern.
Figure 5:
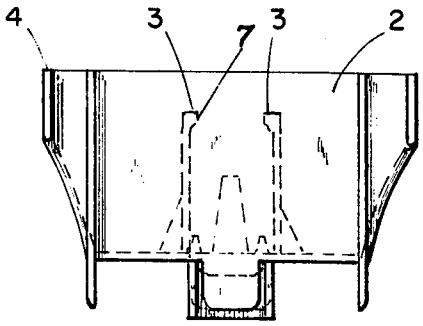
FIG. 5 is a bottom end view of the frame.
Figure 4:
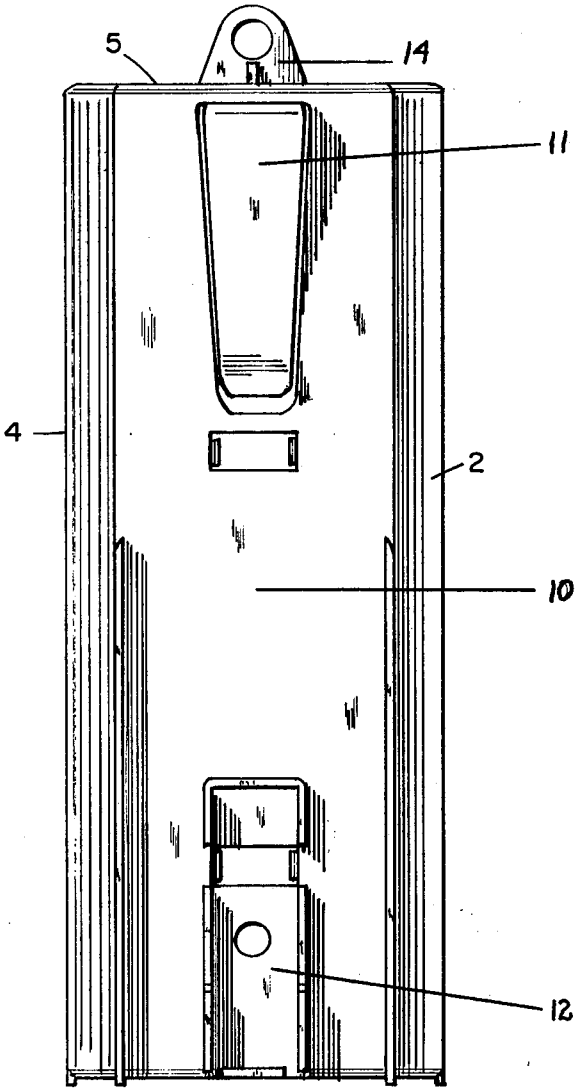
FIG. 4 is a rear view of the lantern frame showing several fittings for convenient use of the lantern.
Figure 2:
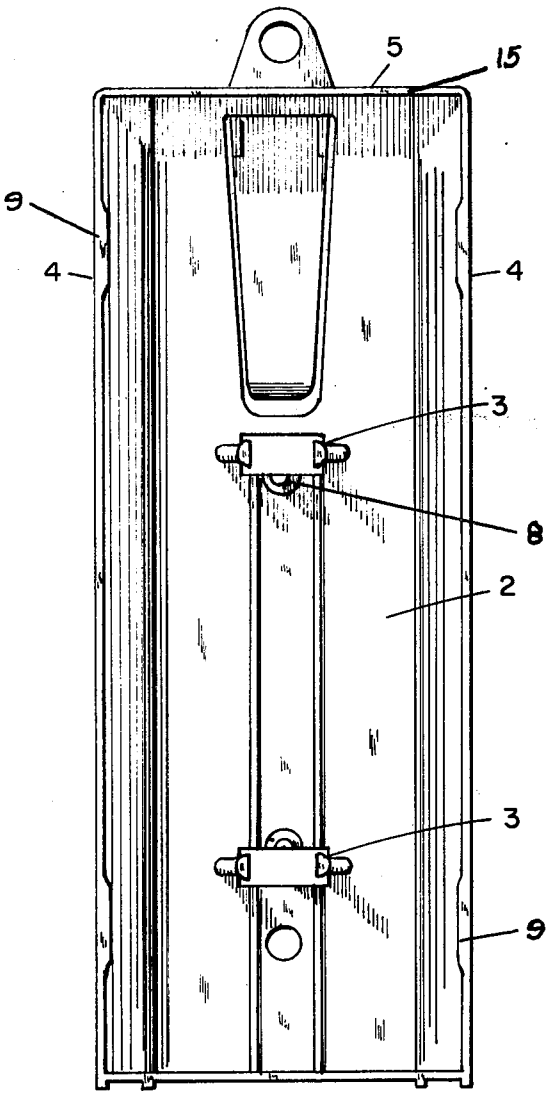
FIG. 2 is a front view of the lantern frame showing its window and inside fittings.
Figure 6:
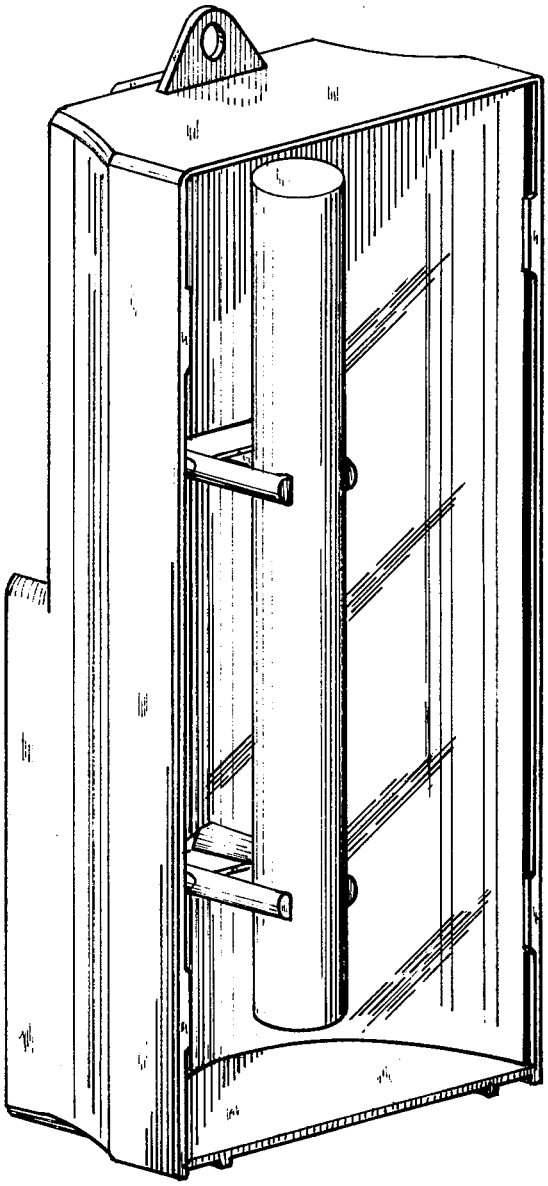
FIG. 6 is an isometric view of the lantern fully assembled.

Referring now in more detail to FIG. 1, a rectangular thin sheet (1) of flexible, resilient, reflective material is shown which will be used to form a curved reflective surface behind the lightstick in the assembled lantern. In our most preferred embodiment, this is a sheet (1) of metallized polyester resin. The sheet has a normally flat disposition but is flexible to form a curved surface. When so curved, the sheet has a permanent resilience tending to force the sheet to its flat disposition. The length of this sheet is measured to fit lengthwise inside the lantern frame which is shown in FIG. 2. The width of the sheet (1) is greater than the width of the lantern frame by enough so that when the sheet is pressed into the frame through the window, the sheet will bend about a longitudinal axis to form a concave reflective surface inside the lantern. The sheet is adapted with apertures (6) to accommodate clamping lugs and stops as will be explained.

In FIG. 2, the lantern frame (2) is a rectangular box with one face open to provide a rectangular window defined by the front edges of the side walls (4) and the end walls (5) of the frame. The length of the frame is slightly longer than the length of the lightstick to be used, so that the selected lightstick for display in the lantern can be conveniently fitted through the window to be held removably in the frame at a display position with the long axis of the lightstick parallel to the frame axis.

The width and depth of the frame are designed to encase the reflective sheet as it is fitted into the frame to form a concave reflective surface which is the longitudinal extension of a desired curve. The curved surface will extend behind the lightstick mounted at its display position in the lantern. The frame is fitted with two sets of clamping lugs inside the box, extending from one or several walls of the frame. In the embodiment shown in the drawings, clamping lugs (3) extend from the rear wall of the frame. These lugs hold the lightstick in a position at the center of the frame and spaced at a desired distance in front of the curved reflective surface. For example, if the curve of the reflective surface is to be the longitudinal extension of a parabola, the lightstick may be positioned in the frame on the longitudinal extension of the focus of the parabola, so that the reflection will be directed outward through the window on parallel lines normal to the plane of the window. The lantern may be designed with other curvatures and lamp positions to obtain other desired reflections. Where the clamping lugs are to extend through the curved reflector sheet, apertures (6) are cut in the sheet for this purpose. In the embodiment shown in the drawings, two sets of clamping lugs (3) are attached to the inside of the rear wall frame on the longitudinal centerline. The two sets of clamping lugs are spaced apart along the same centerline at a distance so that each lug may engage and clamp the lightstick near one of its ends. These lugs extend into the frame from the rear wall through the apertures (6) provided in the reflective sheet. Each set of clamping lugs consists of two resilient prongs spaced apart by the diameter of the lightstick so that the lightstick will fit snugly between the prongs. Each prong in the set has a lip (7) at its free end to retain the lightstick inside the prongs. The prongs are resilient enough so that the lightstick may be forced through the lips by manual force to insert and remove the lightstick. Also, on the centerline between the two lug sets are two stops (8) which also extend from the rear wall to hold the lightstick away from the rear wall at the designed distance for retaining the lightstick at its display position in front of the curved reflector.

The two front edges of the long side walls of the frame, at the window, are extended inward slightly at the window to provide ridges (9) for retaining the two long edges of the curved reflective sheet after the sheet has been inserted into the frame. The ridges hold the long edges of the rectangular reflective sheet within the frame, restraining the curved sheet from forcing itself out of the frame by its own resilient force which is tending to flatten the sheet. In the embodiment shown in the drawings these restraining ridges (9) are extended only partly along each long window edge, but are sufficient to retain the resiliently curved reflective sheet in the frame. The longitudinal centerline of the rectangular reflective sheet will be the deepest part of curved sheet as it forms the curved reflective surface in the frame. The sheet may be supported at that centerline by contact with the rear wall of the frame opposite the window, or it may be supported against one or more stops that extend inwardly from the rear wall. When longitudinal stops are used to support the back of the curved sheet, the stops may be offset at opposite sides of the centerline to bear against lines along the back side of the curved sheet which are parallel to the axis of curvature. These stops will help shape and position the curved sheet in the frame. Any number of such stops may be used as needed. Also, the side walls of the frame may be slanted or curved inwardly so that parts of those walls inside the frame will bear against the curved sheet to help shape and position the curved sheet in the frame to obtain the desired reflective curvature.

The lantern frame may be fitted on its outer surfaces with one or several attachments to facilitate use of the frame. In the embodiment shown in the drawings, the rear wall (10) is fitted with a clip (11) for attachment to a lifevest pocket or the like, and is fitted with a magnet box (12) for holding magnets by which one may attach the lantern to a steel bulkhead or the like and is fitted with parallel strips (13) extending along the rear wall and along one end wall to stabilize the lantern when it is laid with its rear side down, or with the one end down, on a flat surface such as a table, shelf or the like. A tab (14) with a hole for hanging the lantern on a nail or hook is attached to the rear wall at the other end of the frame.

The lantern frame shown in the drawings is a unitary molding of high density polypropylene, with the several fittings shown all being integral molded parts of the single molded unit. The wall thicknesses are all about ⅛ inch and the fittings are all of about the same thickness. The frame is about 1.125 inch deep, 2.375 inches wide at the window and 6.5 inches long, on the inside surfaces. The rear wall of the frame is rectangular, about 1.75 inches wide, inside. Each of the two long side walls comprises a forward rectilinear wall section joined to a curved section extended inwardly from its line of intersection about 0.375 inches behind the front edge of the side wall to the intersection with the long edge of the rear wall. Each of the two end walls of the lantern frame is a flat plane defined by its intersections with the side and rear walls of the frame at right angles and by its front edge (15) which defines one end of the window.

The lightstick for which the lantern shown in the drawings is designed is about five inches long and 0.5 inch in diameter. Accordingly, the clamping lugs are positioned in the frame with the prongs set 0.5 inch apart and with lips extending inwardly about 0.125 inch inward at the free end of each prong. Two stops for the lightstick spaced on the centerline between the two clamping lug sets extend 0.5 inch inward from the rear wall. Each lug set is about one inch long extending from the rear wall. The lug sets are spaced apart longitudinally on the centerline of the frame at a distance of 2.75 inches.

The reflective sheet in the embodiment shown in the drawing is 6.875 inches long and 3.375 inches wide. The sheet is fitted into the frame by pressing it into position, allowing the sheet to bend as it is pressed in. The apertures admit the lugs and stops to pass through the sheet. The longitudinal supporting ribs, raised about 0.125 inch from the rear wall, extend longitudinally along the rear wall, offset from the longitudinal centerline by about 0.25 inch on opposite sides of the longitudinal centerline; the back side of the curved reflective sheet contacts these two ribs at the rear of the lantern. The curved portions of the two side walls of the frame may also contact the curved sheet at points to lend support and to help shape its curvature in the lantern.

Figure 3:
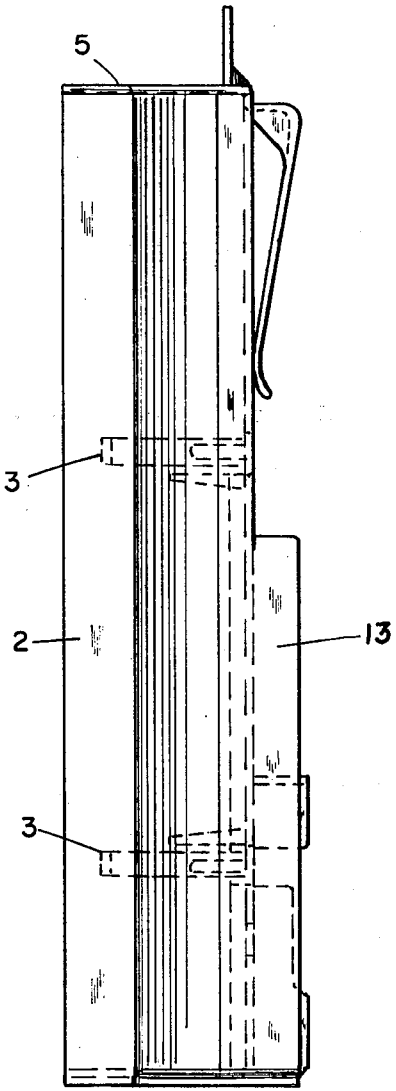
FIG. 3 is a right side view of the lantern frame showing several attached fittings on the frame for convenience in displaying the lantern.

A lightstick is activated by flexing the outer tube and the activated lightstick is pressed between the prongs of the clamping lugs to fix it removably at its display position in the lantern. The lantern, completely assembled as described is shown in FIG. 3.

We claim:

1. A lantern comprising a chemiluminescent lightstick, a lantern frame, and a reflective sheet, said lantern frame comprising a rectangular box having long side walls and end walls, and a rear wall, with one face of said box open to provide a rectangular window defined by the front edges of said side and end walls, the length of said frame being longer than said lightstick; said reflective sheet being fitted in said frame as a longitudinal concave reflective surface and retained said frame by retaining means attached to said frame; said lightstick being held inside said frame by clamping means attached to said frame at a lightstick position in front of said longitudinal concave reflective surface, the longitudinal axes of said frame, concave surface and frame being all parallel with each other.

2. A lantern defined by claim 1 wherein said reflective sheet is held in said frame by retaining means attached to said long side walls and restraining the curved sheet within said frame by its own resilient force.

3. A lantern defined by claim 1 wherein said clamping means for holding said lightstick are attached to said rear wall and spaced apart along the centerline of said wall.

4. A lantern defined by claim 2 wherein said clamping means extend from said real wall through apertures provided in said reflective sheet.

* * * * *